US005419669A

United States Patent [19]

Kremer et al.

[11] Patent Number: 5,419,669

[45] Date of Patent: May 30, 1995

[54] INSTALLATION FOR LINING AN INTERNAL WALL OF AN ENCLOSURE WITH BRICKWORK

[75] Inventors: Andre Kremer, Leudelange; Victor Kremer, Luxembourg; Jeannot Konsbruck, Berbourg; Jean-Jacques Willieme, Peppange, all of Luxembourg

[73] Assignee: Paul Wurth S.A., Luxembourg

[21] Appl. No.: 88,875

[22] Filed: Jul. 7, 1993

[30] Foreign Application Priority Data

Jul. 7, 1992 [LU] Luxembourg ..... 88144

[51] Int. Cl.[6] ..... F27D 1/16; B66F 11/04; C21C 5/44

[52] U.S. Cl. ..... 414/10; 52/747; 266/281

[58] Field of Search ..... 414/10, 931; 52/747, 52/749, 123.1, 122.1; 266/281, 280; 264/30

[56] References Cited

U.S. PATENT DOCUMENTS

| | | | |
|---|---|---|---|
| 4,688,773 | 8/1987 | Legille et al. | 266/281 |
| 4,708,562 | 11/1987 | Mélan et al. | 414/10 |
| 4,720,226 | 1/1988 | Legille et al. | 414/10 |
| 4,765,789 | 8/1988 | Lonardi et al. | 414/10 |
| 4,786,227 | 11/1988 | Kremer et al. | 414/10 |
| 4,787,796 | 11/1988 | Mélan et al. | 414/10 |
| 4,911,595 | 3/1990 | Kirchen et al. | 414/10 |
| 5,018,923 | 5/1991 | Mélan et al. | 414/10 |
| 5,197,847 | 3/1993 | Kremer et al. | 414/752 |

FOREIGN PATENT DOCUMENTS

| | | |
|---|---|---|
| 2300874 | 9/1976 | France . |
| 3621733 | 2/1987 | Germany . |

*Primary Examiner*—Karen B. Merritt

*Attorney, Agent, or Firm*—Fishman, Dionne & Cantor

[57] ABSTRACT

An automated installation for lining a wall of an enclosure with brickwork is presented. This installation comprises a brick laying robot, a depalletizing module, a lifting module, a supply module and a centering ring module. At the level of the centering module which is installed on a working platform, a device for the sequential transfer of the bricks transfers the bricks into a centering position at the periphery of the working platform. In this centering position, the bricks are centered before the brick-laying robot comes to take them up.

24 Claims, 9 Drawing Sheets

INSTALLATION FOR LINING AN INTERNAL WALL OF AN ENCLOSURE WITH BRICKWORK

BACKGROUND OF THE INVENTION

This invention relates to an automated installation for lining a wall of an enclosure with brickwork. More particularly, this invention relates to an automated system that comprises a bricklaying robot to work in the various sectors of an enclosure, a depalletizing module that forms stacks of bricks to suit the needs of the bricklaying robot, a lifting module designed to transfer the depalletized bricks vertically to a working platform and a supply module designed to take bricks to the level of the working platform in accordance with the needs of the brick laying robot. Although this invention is not limited thereto, this invention describes a fully automated installation system for lining the internal surface of a wall of a metallurgical converter with firebrick.

Various robotized installations have been proposed over the last few years for automatically carrying out this work which, until now, was carried out manually. Among these robotized installations, it is possible to distinguish essentially two categories, namely those in which the depalletizing of the bricks is carried out inside the converter, at the level of a working platform (see U.S. Pat. Nos. 4,688,773; 4,708,562; 4,720,226; 4,786,227; 4,787,796; and 5,018,923) and those in which the depalletizing is carried out outside the converter, at a level which is generally accessible to forklift trucks (see U.S. Pat. Nos. 4,765,789 and 4,911,595).

Each of these installations categories has its own advantages and disadvantages. Thus, the installations with depalletizing inside the enclosure have the advantage of speeding up the bricklaying. Indeed, with the exception of relatively short non-productive pauses necessary for the loading of a pallet, the necessary bricks are permanently available on the working platform. These installations with internal depalletizing at the level of the working platform have the disadvantage, however, of considerable overall size at the level of the working platform. The latter must consequently have relatively large dimensions, which makes these installations unusable for converters of smaller diameter. In addition, these installations also have the disadvantage that broken or excess bricks and empty pallets have to be removed from the working platform and out of the converter, which is an operation against the flow of work which slows down the process badly in a fully automated brickhandling process. Finally, installations in which depalletizing takes place at the level of the working platform lack flexibility when more than two types of bricks are used for the brickwork. For reasons of congestion, it is indeed inconceivable to store more than two pallets at the level of the working platform.

For installations with brick depalletizing outside the converter, the abovementioned problems do not arise. These installations are however burdened by a much more complex system for handling the bricks. There is obviously a need to optimize the system for handling the bricks in an installation for lining a wall of an enclosure with brickwork along the lines of a system as presented in document U.S. Pat. No. 4,911,595 (which is assigned to the assignee hereof and fully incorporated herein by reference), in order to speed up the working rate of the bricklaying robot and simplify the system for handling the bricks.

SUMMARY OF THE INVENTION

The above-discussed and other problems and deficiencies of the prior art are overcome or alleviated by the installation for lining an internal wall of an enclosure with brickwork system of the present invention. In accordance with the present invention, a system is provided for the automated installation for lining an internal wall of an enclosure with brickwork, which comprises the major modules and elements as follows:

(1) a bricklaying robot installed on a working platform which can be moved vertically and horizontally to enable the bricklaying robot to work in various sectors of an enclosure such as a metallurgical converter;

(2) a depalletizing module designed to form from pallets containing various types of brick, stacks of bricks that can be used and according to the needs of the bricklaying robot;

(3) a lifting and transfer module designed to receive the stacks of bricks formed by the depalletizing module on a loading platform and capable of transferring the stacks of bricks vertically to a working platform;

(4) a supply module designed to take the stacks of bricks from the lifting and transfer module so as to transfer the bricks sequentially to the level of the working platform in accordance with the needs of the bricklaying robot;

(5) a centering module installed on the working platform at the level of the working platform comprising a device for the sequential transfer of the bricks connecting the supply module with a take-up zone located at the periphery of the working platform close to the sector in which the bricklaying robot is working. There is at least one centering position which is defined in this take-up zone where the bricklaying robot comes to collect the bricks arranged in such a way as to center the bricks in one or more centering positions.

In accordance with the present invention, a centering module is inserted between the bricklaying robot and the module for supplying the working platform. This centering module fulfills two separate functions.

In the first function, the transfer device of the centering module sequentially takes up, from the supply module, the bricks at the level of the working platform and transfers them into a take-up zone located at the periphery of the working platform. The sequential transfer of the bricks towards the sector of the wall where the robot is laying the bricks is therefore carried out simultaneously while the robot is positioning a brick. The path which the robot must cover in order to come back to collect the next brick is substantially reduced, and the robot consequently becomes more productive, that is the robot rate of production increases. In addition, since the take-up zone is at the periphery of the working platform, the result is that the robot can cover the distance between the take-up zone and the place on the wall where it is working at a high speed. It is indeed noted that above the platform, the robot should substantially reduce its speed because of the risk of collision with obstacles and in order to guarantee the safety of the personnel who could be located on the working platform. However, in the empty space between the take-up zone and the wall of the enclosure, there is no risk of collision or of accident, and the speed of the robot can be much higher.

In the second function, the centering device of the centering module centers the bricks in at least one centering position defined in the take-up zone, before the bricklaying robot comes to collect the brick or bricks in this or these centering positions. This centering of the bricks has the advantage that the bricks are always located exactly in the same position. The collection of a brick in this centering position can be carried out "blindly" by the robot since the robot can be preprogrammed to the nearest millimeter with regard to the exact location and relative orientation of the brick. It will be noted that this centering is particularly advantageous if bricks of variable dimensions and/or shapes are being used. If the robot's control system "knows" the type of bricks that the robot has come to collect in the centering position, this control system can directly position to the nearest millimeter a grasping device of the robot above this type of brick and can collect it blindly, that is to say without the aid of sensors making it possible to determine the position and orientation of the brick. Another advantage is that the brick always has exactly the same relative position in relation to the grasping device of the robot. This feature greatly facilitates the final adjustment of the bricks, since frequent readjustments for compensating for a misalignment between the grasping device and the brick are not required.

With regard to the technical embodiment of the centering module and of the transfer module there of course exists a multitude of possibilities. It will however be appreciated that a preferential embodiment of the transfer and centering devices (modules) is proposed, which being of exceptionally small bulk on the working platform, is produced in a simple and rugged design and performs reliably.

The centering device of the centering module is installed on a retractable platform of the working platform. This retractable platform makes it possible to adapt the location of the centering positions to the dimensions of the enclosure to be lined with brickwork and to bring them closer to the place on the wall where the bricklaying robot is working.

The supply module comprises two fork lifters located below the working platform along two opposite sides of a supply channel for the bricks. Each fork lifter then comprises forks which can be turned down from a horizontal position, in which they can support a stack of bricks, into a vertical position, in which they fully clear the supply channel for the passage of the stacks of bricks transported by the lifting module. These fork lifers are driven by at least one step motor via a screw-nut system.

It will be noted that the present embodiment of the supply module compared with an embodiment comprising fixed forks attached to an endless chain such as that described in U.S. Pat. No. 4,911,595 has the advantage of being more rigid, rugged, and more stable. The present embodiment also allows a more accurate transfer of the bricks of the working platform. The improvement in the rigidity makes it possible, inter alia, to work with higher stacks of bricks, that is to say stacks comprising more bricks, without the risk of toppling a stack over.

It will also be appreciated that a particularly simple embodiment of the lifting module is included in the present invention. This lifting module is in fact stabilized by stabilizing cables tensioned between the working platform and the loading platform. The simplicity of this design shows a vast improvement over the design proposed in U.S. Pat. No. 4,911,595 which teaches the use of telescopic rails along which the lifting trucks run by means of rollers.

A simple and ingenious design in accordance with the present invention is used for transferring the stacks of bricks onto the lifting module. A roller conveyor extending from the periphery as far as below the lifting plate is mounted on the loading platform. This lifting plate comprises notches allowing the rollers to pass at least partially above the loading surface of the plate, when the lifting plate is in the loading position. In this way, the stacks of bricks can roll freely above the lifting plate. It remains to be noted that the notches also allow the forks of the two fork lifters to pass in the horizontal position in order to take up the stacks of bricks on the lifting plate.

In U.S. Pat. Nos. 4,765,789 and 4,911,595 the depalletizing module consists simply of a depalletizing robot which is mounted on a rail attached to the loading platform. This arrangement allows the depalletizing robot to move along the loading platform to reach the pallets laid down on a fixed plate. The depalletizing robot directly loads the load-elevators. This depalletizing method taught in the above-mentioned US patents is however likely to delay the supply of bricks to the bricklaying robot as the depalletizing operation and the vertical transfer operation are two operations which follow each other sequentially in time. In addition, the depalletizing robot which can be moved along the loading platform is a complex method, with regard to both mechanics and control.

A preferred embodiment of the depalletizing module in accordance with the present invention renders the depalletizing operation almost independent from the remainder of the installation. This feature provides greater flexibility with regard to the formation of the stacks of bricks, especially when the work involves several types of bricks which are not mutually interchangeable.

The depalletizing module in accordance with the present invention comprises a depalletizing platform installed at the level of the loading platform, a depalletizing robot installed on the depalletizing platform having a working range over this platform, at least one conveyor for brick pallets installed on the loading platform and located at least partially within the working range of the depalletizing robot, at least one conveyor for the stacks of bricks, which is installed on the loading platform and terminates with one end within the working range of the depalletizing robot and with the other end at the periphery of the depalletizing platform, opposite the loading platform. It will be noted that the depalletizing robot preferably is a fixed robot on the depalletizing platform and the pallets are moved relative to the robot, which makes the construction of the robot much simpler. It will also be noted that the depalletizing operation has been completely separated from the vertical transfer operation. The lifting module and the depalletizing module can consequently work at the same time each module at its own rate. It is now perfectly possible to form stack of bricks in advance and to transfer them to a waiting position before loading them onto the lifting module.

The working platform can be constructed in such a way as to be able to rotate about a vertical axis in order to work on successive sections of an enclosure. This rotation is preferably obtained by a rotation of the loading platform, supporting the working platform. In this case, the transfer of the stacks of bricks between the fixed depalletizing module and the working platform is carried out by a transfer plate which revolves about the loading platform.

The bricklaying robot is preferably a robot with four axes, which supports a grasping device for the bricks. The four axes comprise a horizonal translation axis, making it possible to bring the bricklaying robot closer to the wall of the enclosure, two vertical rotation axes and a horizontal rotation axis, making it possible to move the grasping device between the wall of the enclosure and the centering positions. This embodiment provides the robot with a working range which is perfectly suited to the task, while at the same time guaranteeing excellent rigidity of the assembly.

The hanging arm of the grasping device preferably forms a parallelogram which can be deformed in a vertical plane. This embodiment makes it possible to keep the grasping device parallel to itself during a pivoting of the hanging arm, while increasing the rigidity of the robot.

The grasping device also has four degrees of freedom providing for the adjustment of the bricks during the bricklaying work.

In accordance with the present invention, there is a preferential means for handling the bricks. This means makes it possible to guarantee all the flexibility necessary when required to work with several types of bricks, without making the embodiment of the means for handling the bricks more complex. This flexibility is obtained because the depalletizing module comprises two independent conveyors, (that is to say two different channels), for transporting stacks of bricks formed sequentially according to the needs of the bricklaying robot at the loading platform. The lifting module, for its part, only has one loading surface for transporting two stacks of bricks, which facilitates its construction compared with the double lifting truck of U.S. Pat. No. 4,911,595. Each stack of bricks is again handled separately by the supply module of the working platform. This module in fact includes a first supply lifter and a second supply lifter which are preferably independent with respect to each other. These two supply lifters are capable of each taking up one of the two stacks from the loading surface of the lifting module, and transferring the bricks of this stack sequentially to the level of the working platform. The centering module also comprises means for taking up and transferring, according to the need of the bricklaying robot, either a brick from the first supply lifter, or a brick from the second supply lifter, or a pair of brick at the periphery of the working platform, and means for centering the bricks coming from the second supply lifter into a second centering position. To summarize, the installation effectively comprises two channels to supply the bricklaying robot sequentially, according to the needs with various types of bricks. This splitting into two sequential channels makes it possible to create the necessary flexibility for working with various types of bricks which are not mutually interchangeable.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
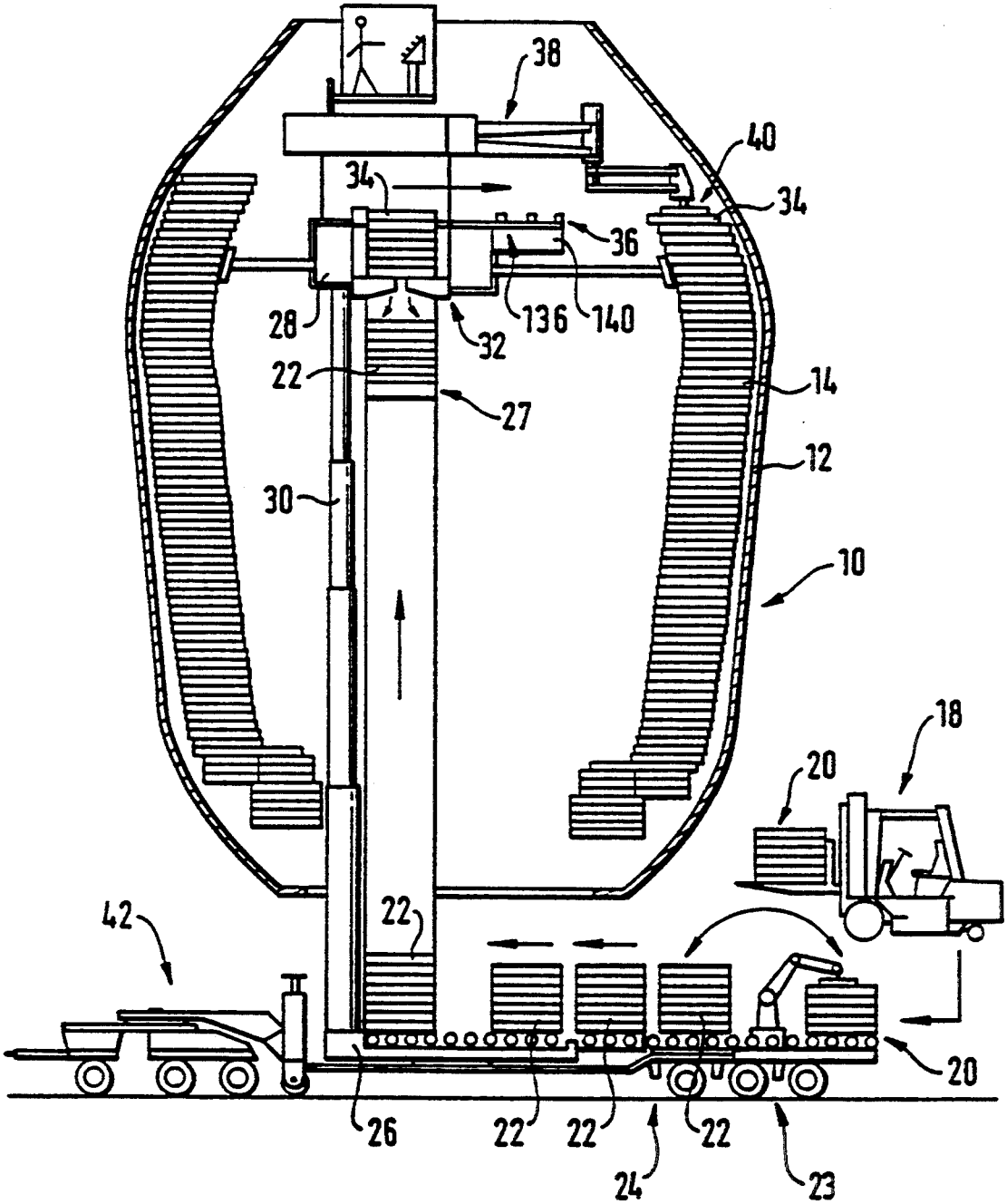
FIG. 1 shows an overall diagrammatical view of an installation in accordance with the present invention, which is in the process of lining an internal wall of a metallurgical converter, shown in section, with fire brickwork.

FIG. 1 shows an overall diagrammatical view of a fully automated installation for lining the internal surface of a wall of a metallurgical converter with fire brickwork in accordance with the present invention. The metallurgical converter 10 is shown in section. More precisely, it is a converter with removable bottom as is commonly used in the European iron and steel industry. Its metal shell 12 and its refractory lining 14, which have to be renewed at more or less frequent intervals, can be seen. The bottom of the converter has been removed in order to form the refractory lining of the converter.

Before starting the detailed description of the installation, its method of operation will be described with the aid of FIG. 1. A fork lift truck 18 brings the pallets 20 of bricks to a depalletizing module 23. This depalletizing module 23 forms as required, stacks of bricks 22 and conveys these stacks of bricks 22 onto a transfer module 24, which supplies a lifting module 27 at the level of a lower rotating platform 26 (or loading platform). This lifting module 27 brings the stacks of bricks 22 to a position directly below a working platform 28 (or upper platform) which is supported by a telescopic mast 30 on the lower rotating platform 26. At this level, the stacks 22 are taken up by a supply module 32 which passes bricks 34 sequentially to a centering module 36, arranged on the upper platform 28. This centering module 36 transfers the bricks 34 sequentially into a centering position 136 defined on a centering table 140, from which a bricklaying robot 38 comes to collect the bricks by means of a grasping device 40 in order to position them along the wall 12 of the converter. The whole installation is preferably mounted on a trailer 42.

Figure 2:
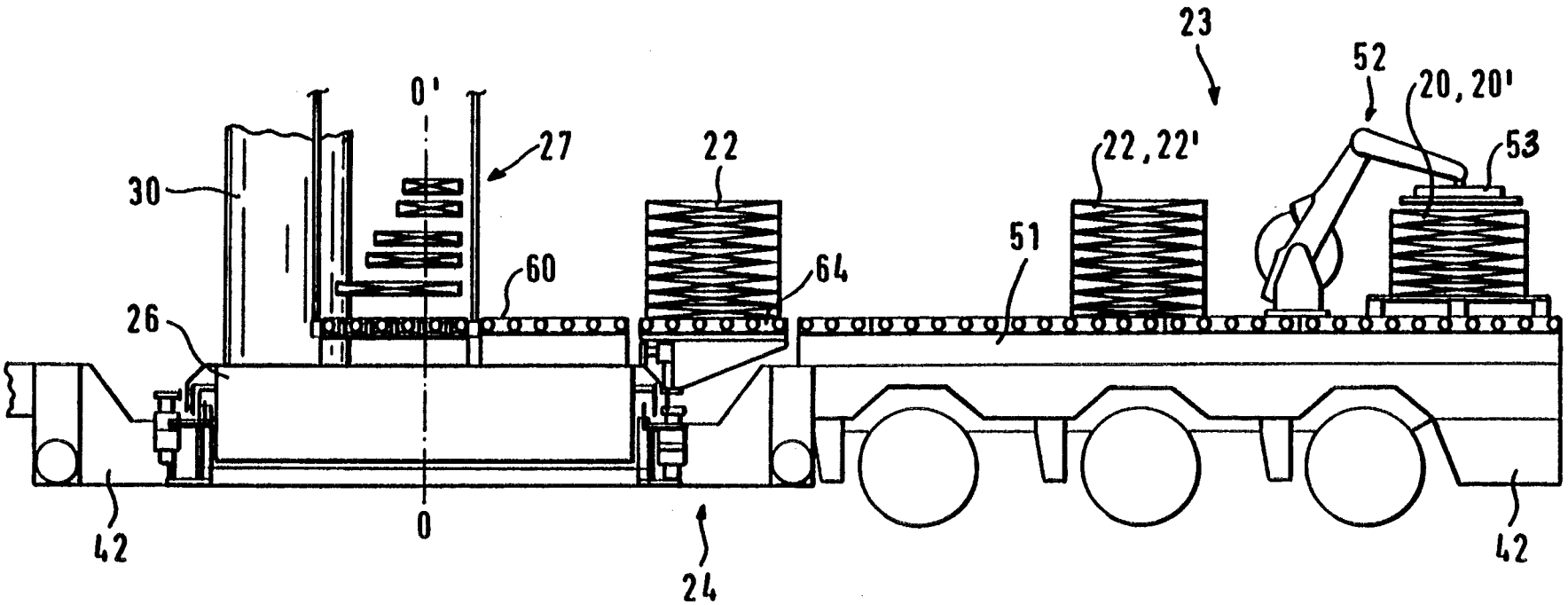
FIG. 2 shows an elevation of the depalletizing module, of the transfer module and of the loading platform of the installation in accordance with the present invention.

The depalletizing module 23 will be described with reference to FIGS. 2 and 3. FIG. 2 shows an elevation of the depalletizing module 23. Depalletizing module 23 comprises a depalletizing platform 51 which is installed on the trailer 42. There is however no reason why the depalletizing module 23 could not be installed on a separate trailer. The separate trailer would then be hitched up to the trailer 42, supporting the lower platform 26 and the transfer module 24, when this platform is installed below the converter 10.

Figure 3:
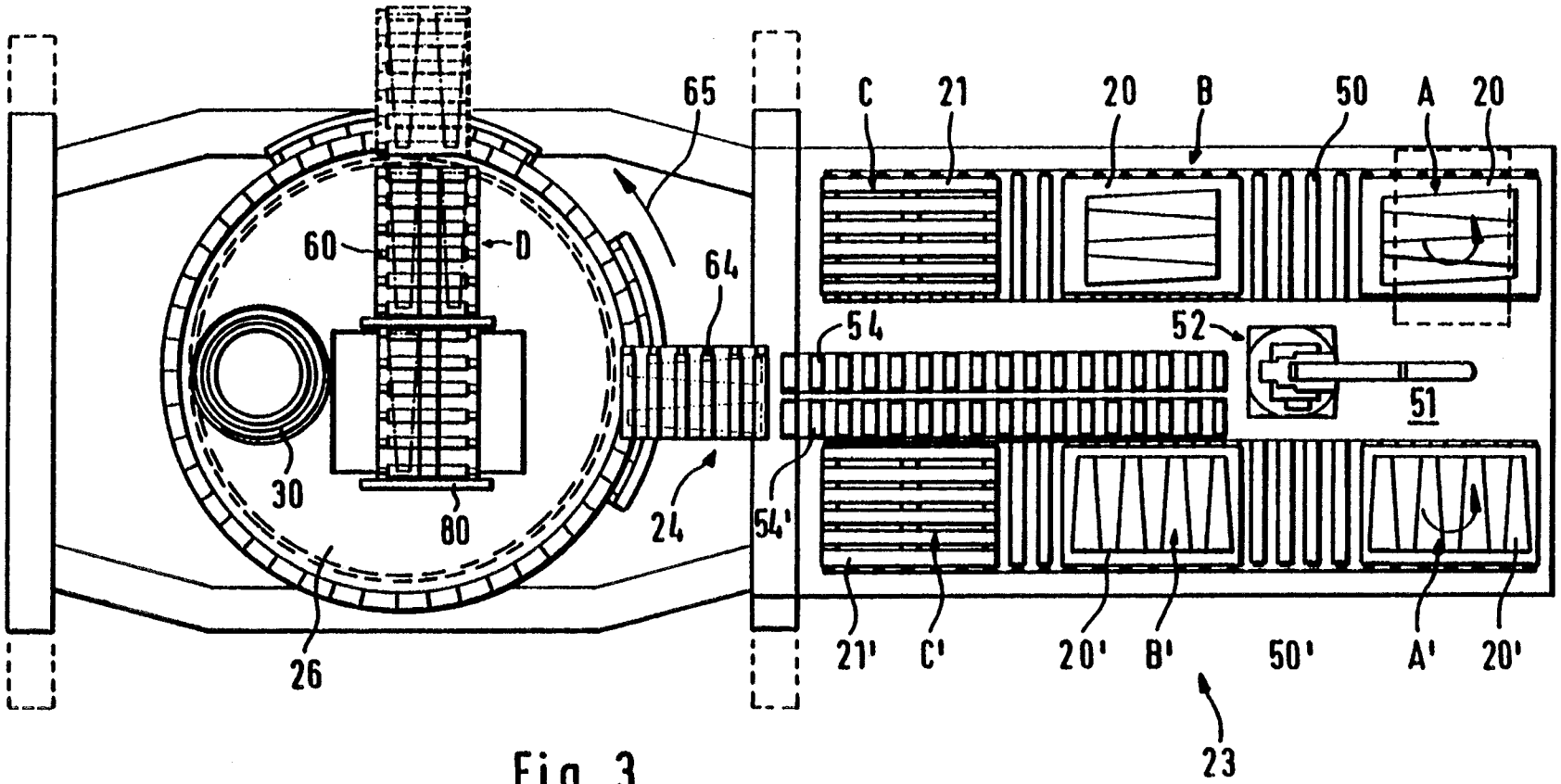
FIG. 3 shows a plan view of the modules of FIG. 2.

FIG. 3 shows a plan view of the depalletizing module 23. A first roller conveyor 50 installed along a first side of the depalletizing platform 51 and a second roller conveyor 50' installed along the opposite side of the depalletizing platform 51 can be seen. The forklift truck 18 sets down its pallet 20 with the bricks either on the first conveyor 50, or on the second conveyor 50', depending on whether the bricks are of a first or second type. The position for setting down the pallets is located at the rear of each conveyor and is denoted in FIG. 3 by the letters A and A'. Each of these setting-down positions A and A' preferably consists of a rotating table making it possible to rotate the pallets through 90° about a vertical axis after they have been set down by the truck 18. The orientation of the pallet when it is set down by the truck 18 has been indicated with dashes for the position A in FIG. 3. A depalletizing robot 52 is installed between the two conveyors. It is for example a robot with six axes, fitted with a grasping device 53 with pneumatic suction cups. For this robot 52, there has been defined, on each of the two conveyors 50, 50', one or more positions in which it is capable of taking a brick from a pallet 20 by means of its grasping device 53. Two pallet location positions known by the robot 52 have been denoted by the letters B and B'. Depending on the needs, it is however possible to increase the number of depalletizing positions on the two conveyors 50, 50'. The robot 52 then sets down the bricks on a first central conveyor 54 or on a second central conveyor 54' in order to construct the stacks of bricks 22, 22'. These stacks can comprise a variable number of bricks. Furthermore, for reasons of stability, excessively high stacks, for example exceeding eight superimposed bricks per stack, should, however, be avoided. The conveyors 54 and 54' are preferably roller conveyors arranged parallel between the conveyors 50 and 50'.

It is important to note that the depalletizing robot 52, which is provided with its own programmable process controller, is also controlled by a monitoring computer which manages the interaction of the various modules of the installation (system). The depalletizing robot can thus form the stacks 22, 22' on the conveyors 54 and 54' according to the needs of the bricklaying robot. Indeed, the bricks used may have to have different shapes, dimensions and/or qualities. An algorithm which manages the laying of the bricks makes it possible, meanwhile, to determine in advance the order in which these bricks are used. Since the robot 52 "knows" exactly which brick type is located on the pallets at locations B, B', it can form the stacks 22, 22' in the reverse order to that in which they are used by the bricklaying robot 38.

In order to increase the flexibility of the system, a split supply channel is provided, represented on the depalletizing module by the two parallel conveyors 54 and 54'. In this way, the first channel can for example contain a stack 22 in which the sequence of bricks has been precalculated using a laying algorithm, while the second channel can contain bricks which are used to correct deviations which are not accounted for by the laying algorithm, that is to say, which are only detected a posteriori according to the measurements carried out continuously by the laying robot 38. It would of course also be possible to provide more than two supply channels in parallel. Simulations have however shown that two channels provide sufficient flexibility, in view of the small number of brick types used and of the corrections to be carried out in order to take into account the errors in the geometry of the converter. A strictly serial supply with only one supply channel would however lead to the installation being stopped in the event of the robot 38 requiring a brick other than that contained sequentially in the stack.

The empty pallets 21, 21' are transferred by the conveyors 50 and 50' into take-up positions C and C', where the fork lift truck 18 comes to collect them. It remains to be noted that the grasping device 53 is equipped with means known per se for detecting broken bricks. The latter are removed together with the empty pallets 21, 21'.

The transfer module is described with the aid of FIGS. 2 and 3. This module transfers the stacks of bricks 22, 22' between the conveyors 54, 54' and the lower platform 26. A conveyor 60 supplying the lifting module 27 is installed on this platform. Since the platform 26 can rotate about a vertical axis O, O', the conveyor 60 is not always aligned with the double conveyor 54, 54' of the depalletizing module. This is the reason why the transfer module 24 consists of a segment of roller conveyor 64 which can revolve about the platform 26 in order to align itself either with the double conveyor 54, 54' in order to take up one or two stacks of bricks 22, 22' taken up from the depalletizing module, or with the conveyor 60 in order to transfer these stacks of bricks towards conveyor 60. In this way, the conveyor 60 can be supplied in all the positions of the lower rotary platform 26. The segment 64 is shown in FIG. 3 once in alignment with the double conveyor 54, 54' and once, after rotation, in alignment with the conveyor 60 supplying the lifting module 27. The arrow 65 symbolizes this rotation.

A waiting position denoted by the letter D is arranged at the input of the conveyor 60. The stacks set down in this waiting position form a reserve with which to supply the lifting module 27. This operating method avoids a waiting time with regard to the loading of the lifting module 27, and consequently, with regard to the supply of the upper platform 28. If a stack or a pair of stacks is transferred onto the lifting module, the waiting position D is once again supplied with the next stack or pair of stacks, prepared by the depalletizing module 23.

Figure 4:
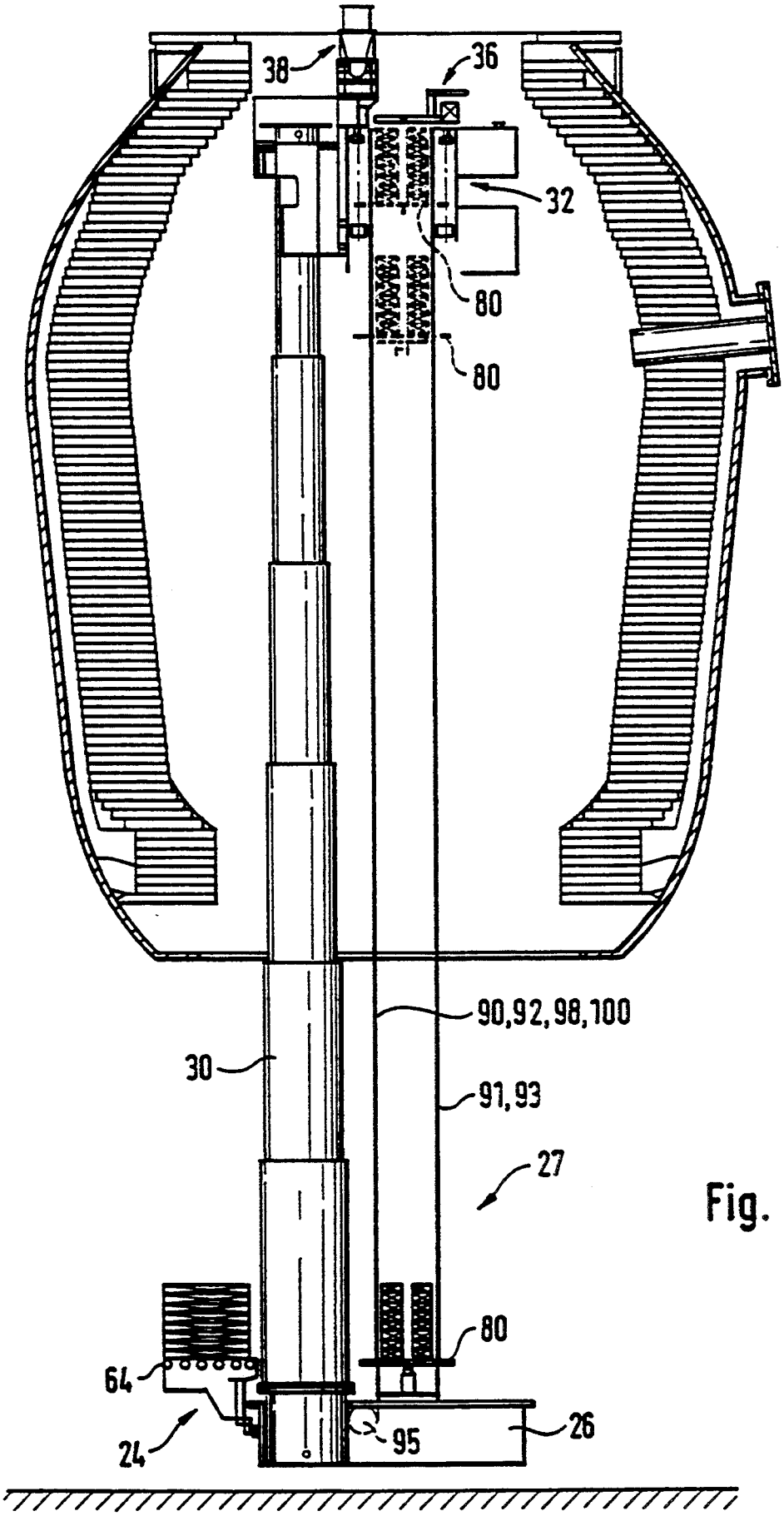
FIG. 4 shows a more detailed overall view of the installation without the depalletizing module and without the trailer supporting the installation of FIG. 2.
Figure 5:
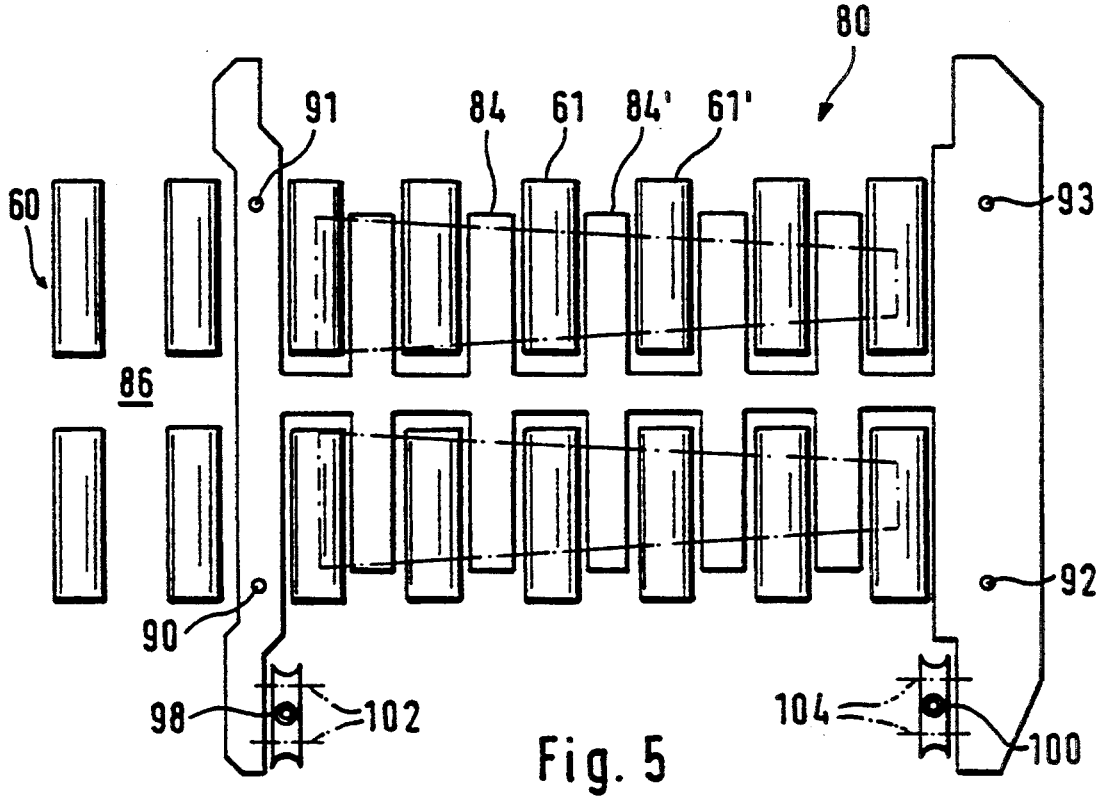
FIG. 5 shows a plan view of the lifting plate in the loading position.
Figure 6:
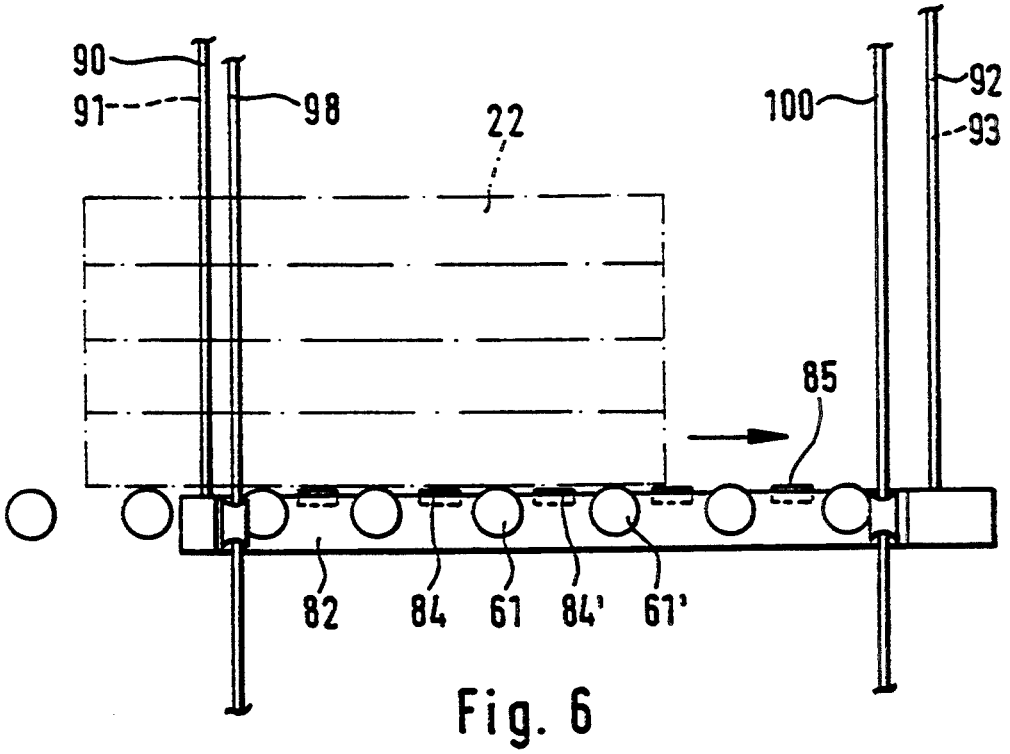
FIG. 6 shows an elevation of the lifting plate in the loading position.

The lifting module 27 is examined with the aid of FIGS. 4, 5 and 6. The function of the lifting module 27 is to transport the pair of stacks waiting on the conveyor 60 as far as below the upper platform 28 where the stacks of bricks are taken by the supply module 32. The lifting module 27 comprises a loading plate 80 which is shown by FIG. 5 in plan view and by FIG. 6 in elevation, each time in the loading position on the lower platform 26. This plate is made up of a crossmember 82, which is provided on each side with perpendicular strips 84 defining a loading plane 85. The strips 84 are arranged in such a way that they can each penetrate into the space between two successive rollers 61, 61' of the roller conveyor 60. A lifting plate also comprises notches enabling the rollers of the conveyor to pass at least partially above the loading surface of the lifting plate when the lifting plate is in the loading position. The crossmember 82 can penetrate into a space 86 created between two parallel rows of rollers. FIG. 6 shows that the loading surface 85 is located slightly below the rolling surface defined by the rollers 61 of the conveyor 60. This enables the stacks of bricks 22 to move freely along the conveyor 60 above the plate 80. When the plate 80 is lifted, the stacks 22, 22' are supported by the strips 84 on each side of the crossmember 82.

Figure 7:
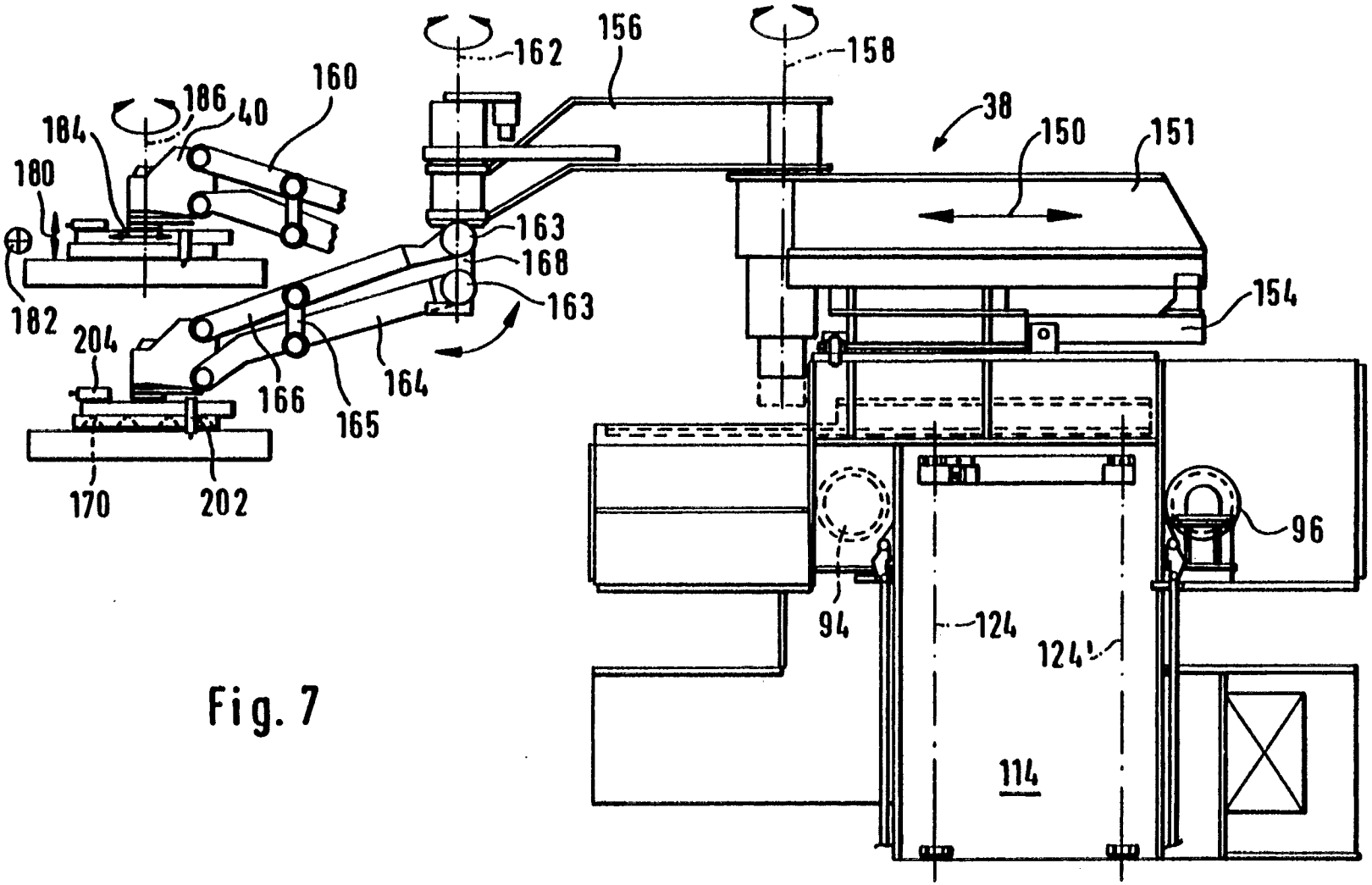
FIG. 7 shows a section through the working platform with an elevation of the brick-laying robot.

The plate 80 is preferably supported by four supporting cables 90, 91, 92, 93 which are fixed to the four comers of the plate 80 and driven in pairs by a first winch 94 and second winch 96, which are mounted on the upper platform 28 (see FIG. 6 also see FIG. 7). The plate 80 is preferably guided by at least two additional cables 98, 100 which are tensioned between the upper platform 28, to which they are fixed (see FIGS. 4 and 6), and the lower platform 26. At the level of the lower platform 26, the two stabilizing cables 98, 100 are wound on a motorized drum. This motorized drum 95 ensures that the guiding cables 98, 100 are always tensioned with a constant force between the lower platform 26 and the upper platform 28, when the upper platform 28 is moved vertically in relation to the first one by an extension or retraction of the telescopic mast 30. In order to be guided by the cables 98, 100 during its upward or downward movement, the plate 80 is provided with two pulley pairs 102, 104. Each pulley pair 102, 104 interacts with a guiding cable 98, 100 in order to avoid any instability of the plate during its travel (see FIGS. 5 and 6). It will be noted that this guiding system is particularly simple, while providing the plate 80 with sufficient stability during its travel in the vertical direction. It would of course also be possible to work with a greater number of guiding cables.

In FIG. 4, the plate 80 carrying two stacks of bricks is shown in a loading position at the level of the lower platform 26, in a waiting position below the upper platform and in an upper position in which the transfer of the two stacks of bricks onto the supply module 32 takes place.

Figure 8:
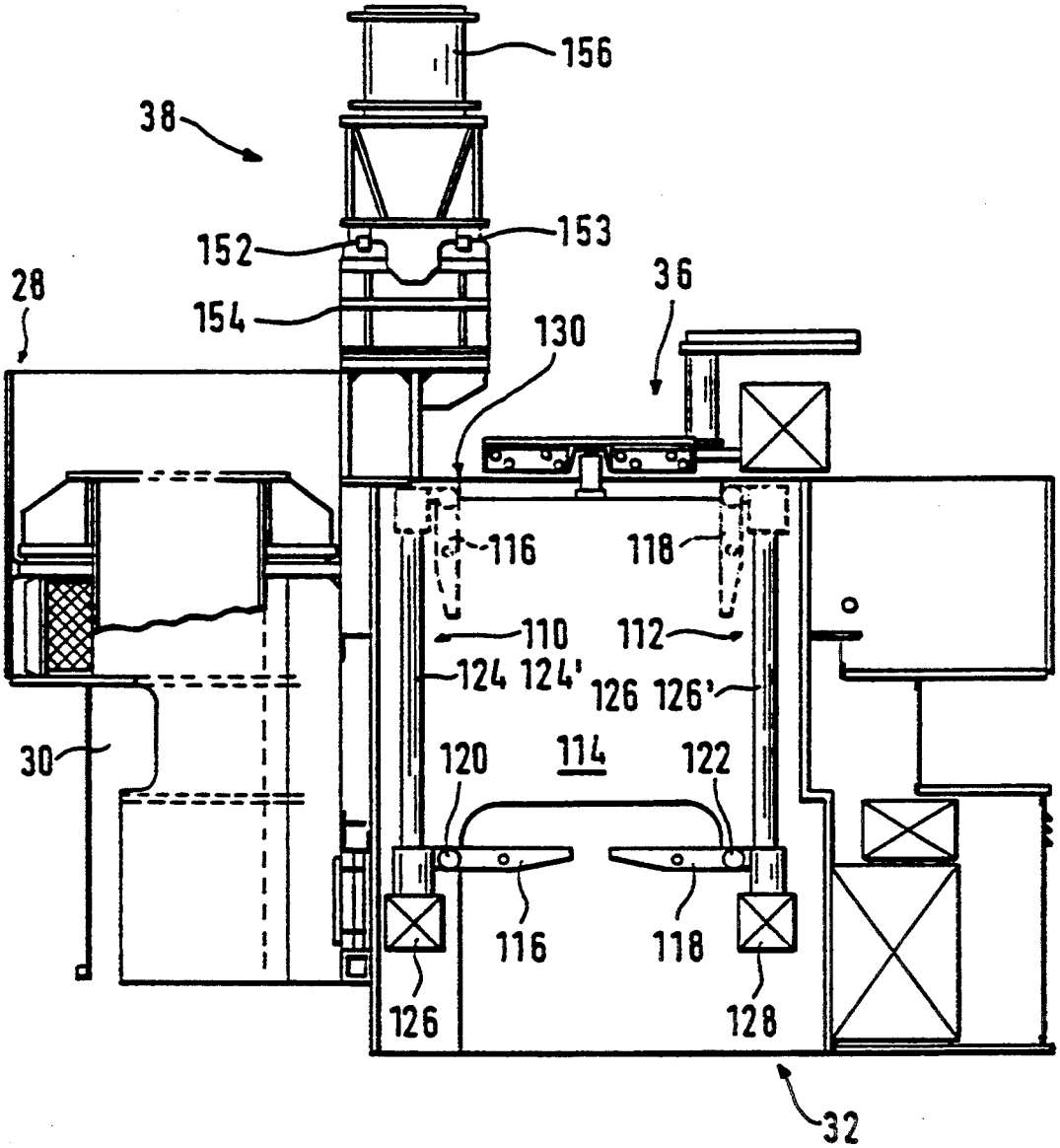
FIG. 8 shows a section through the working platform in a plane perpendicular to the sectional plane of FIG. 7.

The supply module 32 is described with the aid of FIG. 8. Its function is to take up a stack of bricks, or pair of stacks of bricks, from the lifting plate 80, and to transfer the bricks sequentially to the level of the working platform 28, where they are taken up by the centering module 36. The supply module 32 comprises two fork lifters 110, 112 which are installed opposite each other in a supply channel 114, arranged in the upper platform 28. Each fork lifter 120, 122 comprises for example six forks 116, 118 which are arranged so as to fit into the six notches defined on either side of the plate 80 by the strips 84 (see FIG. 5). The fork 116, 118 of a fork elevator 110, 112 form a block which is mounted by means of a horizontal articulation 120, 122 on a vertical driving system. Each of these two articulations 120, 122 is provided with a driving device (not shown) which makes it possible to turn down the forks 116, 118, which are normally in the horizontal position for supporting the stacks of bricks, into a vertical position. In FIG. 8, the forks 116, 118 are shown at the bottom of the channel 114 in the turned-down position. The turned-down position releases the amount of space required in the channel 114 in order to raise two stacks of bricks by means of the lifting module 27 between the two fork lifters 110 and 112 (see FIG. 4). When the plate 80 reaches its upper position, the forks 116, 118 can be lowered in the turned-down position along the two stacks of bricks, in order to be placed in the horizontal position below the plate 80 of the lifting module.

The system 124, 124' for vertically driving each fork lifter 110, 112 is preferably a screw-nut system, driven by a step motor 126, 128. It should be noted that in FIG. 8, this driving system is only shown diagrammatically for simplicity. In FIG. 7, the two screws for driving the fork lifter 110, 112 are represented by their axis 124, 124'. This screw-nut system in which the nut is fixed in rotation and the screw is fixed in translation causes, by its rotation, the translation of the nut. This is a simple driving system, which furthermore has the advantages of being compact and allows a precise adjustment of the level of the claws and therefore of the supply level 130 of the upper platform and guarantees that the two lifters are guided in a preferred manner. This supply module 32 makes it possible, for example, to raise either the stack supported by the lifter 110 or the stack supported by the lifter 112 by the thickness of one brick, so that the lower surface of the upper brick of the stack in question coincides with the level of the surface 130. Meanwhile, the lifting plate 80 can move back down to the level of the lower platform 26 in order to be reloaded with the stack(s) waiting in the position D of the conveyor 60. At the surface 130, the brick which has been raised by the fork lifter 110 or 112, is collected by the centering module 36.

The centering module 36 takes up the bricks raised by the supply module 32 to the surface 130 and transfers them horizontally into a position, at the periphery of the working platform 28, which is exactly defined and where the brick-laying robot 38 comes to collect them. The centering module 36 comprises an axial pusher 132 (see FIG. 9) which comes to collect the brick 134, as far as the end of the channel 114 in the surface 130, in order to push it by a movement of translation, symbolized by the arrow 133, in front of itself, into a centering position 136 located at the periphery of the upper platform 28. This centering position is more precisely located in the continuation of the longitudinal axis of the brick 134 supported by the supply lifter 110. A second centering position 136', identical to the centering position 136, is arranged at the same level in the continuation of the longitudinal axis of the brick 134' supported by the supply lifter 112, so as to create two parallel supply channels. The axial pusher 132 is preferably driven by a pneumatic jack 138, of the type having no piston rod. It could however also be driven by an endless chain provided with a suitable driving motor.

Figure 9:
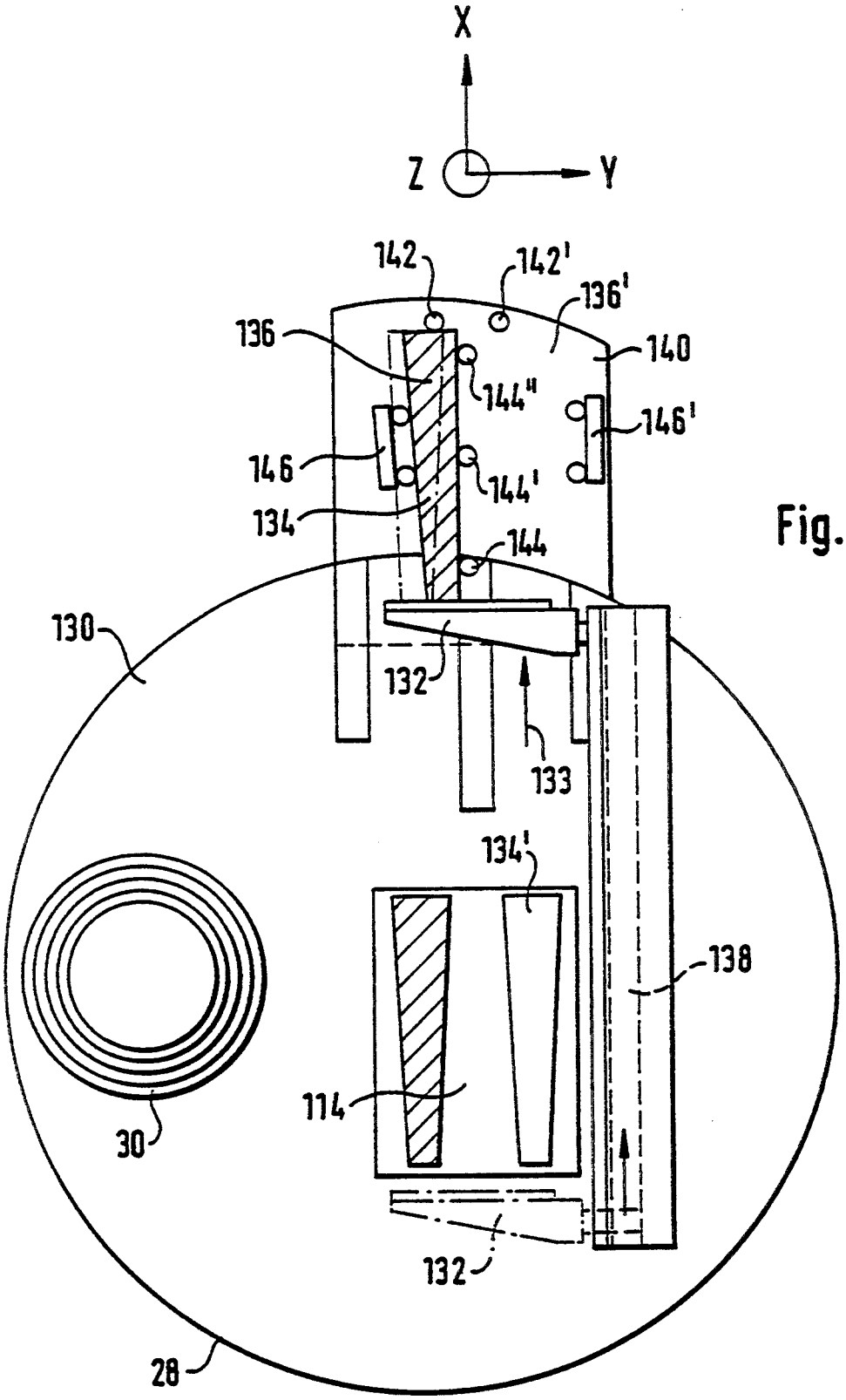
FIG. 9 shows a plan view of the centering module on the working platform.

The centering positions 136 and 136' are preferably arranged on a retractable plate 140, which can be extended in the radial direction of the upper platform 28 depending on the diameter of the converter 10. For this purpose, this plate 140 is mounted on rails and driven by a pneumatic jack (not shown). In the direction of the longitudinal axis of the bricks 134, 134', these two centering positions 136, 136' are defined by two stops 142, 142' against which one of the small lateral sides of the bricks bear. Stops 144, 144', 144'', arranged parallel to the direction of displacement of the pusher 132, define a bearing surface for one of the large lateral sides of each brick. FIG. 9 shows that the pusher 132 has pushed the brick 134 against the stop 142. During a next stage, a lateral pusher 146 comes to bear on a large lateral side of the brick 134 in order, thus, to push the brick 134 against the stops 144, 144', 144''. The result of this is that the position of the brick 134 is known by definition to the nearest millimeter along the three axes X, Y, and Z by the management program of the bricklaying robot 38. In addition, since the centering positions 136 and 136' are located at the periphery of the platform 28, the bricklaying robot 38 has a trajectory which is much simpler and shorter to travel along. It goes without saying that the coordinates of the two centering positions 136, 136' are of course automatically compensated for if the retractable platform 140 is extended by a varying amount in the direction of the X axis. A centering of the brick 134' in the position 136' takes place in the same way by means of an axial stop 142' and a pusher 146' which pushes the brick against the same stops 144, 144', 144''. In this way, a simultaneous centering of a pair of bricks can take place without difficulty. While the centering of the bricks takes place, and the robot comes to collect one of the two bricks, the pusher 132 can already move back behind the channel 144 in order to wait for the supply module 32 to raise the next brick or pair of bricks. The latter can then be pushed by the pusher 132 into a waiting position located just in front of the centering positions 136, 136'. It follows that the handling of the bricks no longer causes any delay in the work of the bricklaying robot 38.

The bricklaying robot is described with the aid of FIG. 7. After a brick has been centered by the centering module, the bricklaying robot 38 comes to collect it at one of the centering positions 136, 136' whose coordinates are perfectly known by the management system of the robot. The bricklaying robot is for example a robot of the SCARA type with four degrees of freedom. The first degree of freedom is a horizontal translation in the directions of the arrow denoted by the reference 150. For this purpose, the robot 38 has a base 151 which can slide on rails 152, 153 mounted on a support 154 of the working platform 28 (see FIG. 8). The second degree of freedom is a rotation of a first arm 156 about a vertical axis of rotation 158, defined in the base 15 1 and an end of the arm 156. The third degree of freedom is a rotation of a second arm 160 about a vertical axis of rotation 162, defined in the other end of the first arm 156 and in an end of the second arm 160. The fourth degree of freedom is a rotation of the arm 160 about an axis of rotation 163 which is perpendicular to the vertical axis of rotation 162.

The arm 160 supports at its free end the grasping device 40. It will be noted that the arm 160 is advantageously formed by two parallel superimposed bars 164, 166. These bars 164, 166 are articulated, at one end, to a component 168 which represents the vertical axis of rotation 162 and, at the other end, to the grasping device 40, so as to form a parallelogram which can be deformed in a vertical plane. An articulated crossmember 165 increases the rigidity of the arm 160, made up of the two bars 164, 166. This assembly guarantees that the lower surface of the grasping device 40 which supports, for example, pneumatic suction cups 170, stays parallel to itself during rotation of the arm 160 about its horizontal axis of rotation 163. It goes without saying that the fourth degree of freedom could also have been provided in the form of a vertical translation.

The grasping device also has four degrees of freedom in order to provide for the final adjustment of the bricks. The first degree of freedom is a vertical translation indicated by the arrow 180. The second degree of freedom is a horizontal translation indicated by the reference 182. The third degree of freedom indicated by the reference 184 is a horizontal translation in a direction perpendicular to the second degree of freedom. The fourth degree of freedom is a rotation about a vertical axis 186. The translations denoted by the references 180, 182, 184 are produced by pneumatic or electrical driving devices. The rotation about the axis 186 can be a free rotation. The combination of a robot 38 having four degrees of freedom with a grasping device 40, itself also having four degrees of freedom, makes it possible to obtain not only high precision with regard to the laying of the bricks, but also to optimize the trajectory and consequently the working speed of the bricklaying robot 38. For a more detailed description of a handling device of this type, reference is made to European Patent Application EP 0,477,661 A1 (corresponding to U.S. Pat. No. 5,197,847, assigned to the assignee hereof and incorporated herein by reference).

Figure 10:
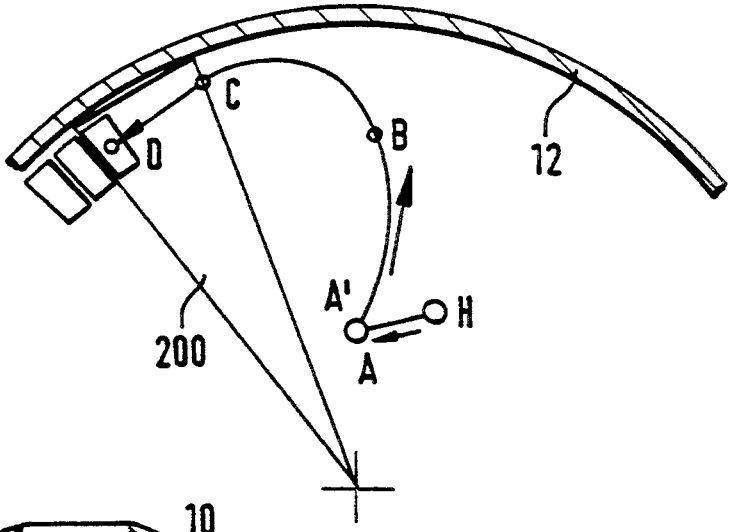
FIG. 10 shows diagrammatically the trajectory of the grasping device of the bricklaying robot.
Figure 11:
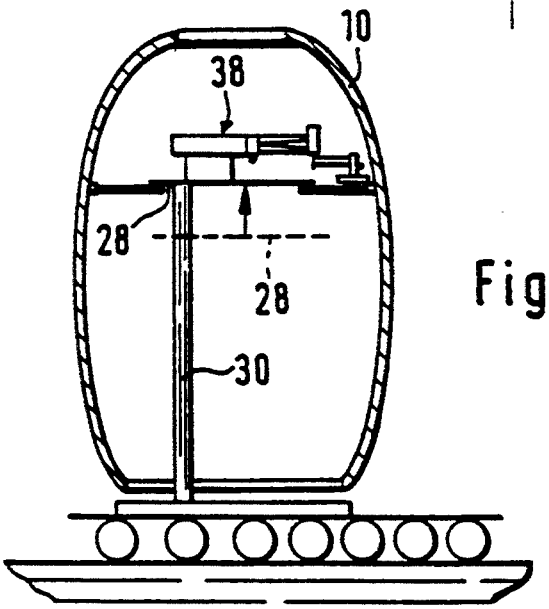
FIG. 11 shows diagrammatically the vertical transfer of the working platform inside the converter.

The operation of the bricklaying robot 38 is described with the aid of FIG. 10. The movements of the robot are controlled by a programmable process controller which is controlled by the management computer of the installation (the programmable process controller and the management computer are not shown). At the start of a cycle, the grasping device 40 is located in a waiting position H ("home position"). The management computer transmits to the programmable process controller toward which centering position 136, 136' the robot is to move, the type of brick which is located there and determines the trajectory for arriving there. The grasping device 40 moves down at a reduced speed towards the centering position indicated by the A in FIG. 10. The pneumatic suction cups 170 of the grasping device 40 are subjected to a vacuum in order to take hold of the brick in the centering position A. The robot then lifts the brick to a position A' above the centering position A in order to avoid any collision with the centering stops 142, 144', 144'', 144'''. When it has arrived at A', the robot moves the brick at a high speed along a preestablished trajectory via the position B to the point C, which is located in proximity to the wall 12 of the converter 10. It will be appreciated that this trajectory A, B, C can be travelled along without risk of collision with some element of the upper platform 28 and without danger for a person who may possibly be located on the platform 28. This is possible by virtue of the peripheral position of the centering position A on the upper platform. A safety zone, denoted in FIG. 10 by the reference 200, starts at the point C. The robot reduces its speed to a value which allows corrections in the trajectory according to measurements carried out by distance sensors. These sensors are for example ultrasound sensors. They are installed on the grasping device 40 and are denoted in FIG. 7 by the references 202 and 204. During the trajectory CD, the orientation of the grasping device 40 must be such that its longitudinal axis is perpendicular to the wall 12 of the converter in order to enable the sensor 204 to carry out accurate distance measurements of the separation between the grasping device 40, or the brick, and the wall 12 of the converter. By virtue of the centering position, the programmable process controller in fact knows exactly the position of the brick in relation to the grasping device 40. The sensor 202 measures the vertical distance of the grasping device, or the brick, in relation to the upper row of the bricks which have already been positioned. These distance measurements are interpreted by a control module with generates suitable corrections in the speed and in the trajectory. When the detector 202 detects the last positioned brick, the robot 38 is stopped and the programmable process controller activates the grasping device 40 and controls the four degrees of freedom of the latter. The function of the grasping device 40 is now to arrange the brick with the bricks which have already been positioned, according to a laying technique defined by a bricklaying algorithm, activated by the management computer. The choice of bricklaying algorithm is made according to the zone of the converter 10 which the robot 38 is working (lower part or upper part, region around the tap hole, etc.).

The programmable process controller measures the displacement of the grasping device 40 and determines its instantaneous position. It then sends data relating to the last positioned brick to the management computer which thus has at its disposal all the information necessary to determine the general appearance of the refractory lining 14 which has already been produced. The robot then returns at high speed to its waiting position H, in order to wait for a new command from the management computer.

Figure 12:
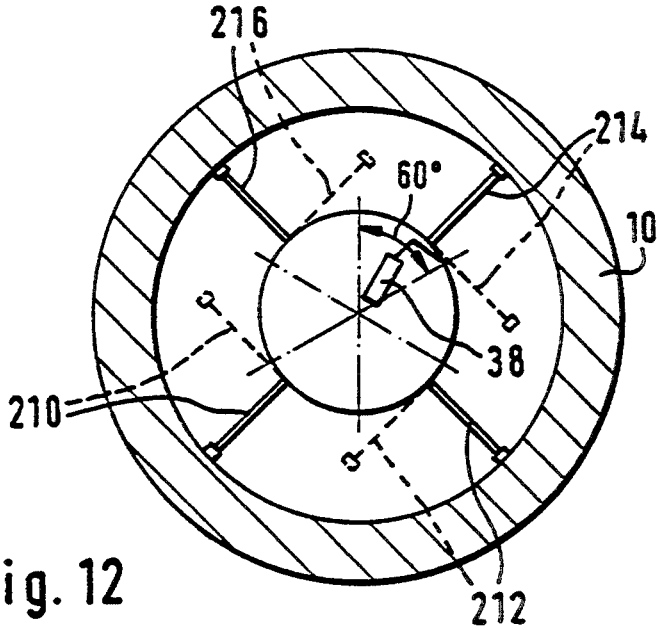
FIG. 12 shows diagrammatically the rotation of the working platform inside the converter.

The bricklaying robot 38 has a working zone inside the converter which is for example limited to 60°. The converter is consequently divided circumferentially into six sectors (see FIG. 12). When the robot 38 is producing the refractory lining of one sector, the platform 28 is radially stabilized in the converter 10 by radial stabilizing arms 210, 212,214, 216 (see FIG. 12) which bear on the lining which has already been positioned (see FIG. 1). After having completed the lining of one sector, the stabilizing arms 210, 212, 214, 216 are retracted or folded in, in order to enable the platform 28 to be moved through an angle corresponding to the angle of the sector which the bricklaying robot 38 has just completed. The folded-in position of the arms is shown diagrammatically with dashes in FIG. 12. The rotation of the platform 28 is produced by a rotation of the lower platform 26 supporting the telescopic mast 30. After this rotation of the upper platform 28, upper platform 28 is once again stabilized by the arms 210, 212, 214, 216 and the lining of the next sector can be started on.

After the robot 38 has completed the lining of all the sectors corresponding to the same bricklaying level, that is to say when the platforms 26, 28 have rotated through a total of 360°, the upper platform 28 has to be raised to the next level. For this purpose, the stabilizing arms 210, 2 12, 214, 216 are withdrawn or folded in, and the telescopic mast 30 lifts the upper platform to the next bricklaying level. In this position, the mast 30 is for example locked pneumatically, the stabilizing arms 210, 212, 214 and 216 are unfolded and the robot 38 can resume its work.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. Automated installation for lining the wall of an enclosure with brickwork comprising:

a bricklaying robot mounted on a working platform which can be moved vertically and horizontally to enable the bricklaying robot to work in various sectors of said enclosure;

a depalletizing module for forming from pallets with various types of bricks, stacks of bricks according to the needs of the bricklaying robot;

a lifting module, for receiving said stacks of bricks formed by the depalletizing module on a loading platform said lifting module being capable of transferring the stacks of bricks vertically to the working platform;

a supply module for supplying the working platform, and for taking up said stack of bricks from the lifting module and transferring the bricks sequentially to the level of the working platform, according to the needs of said bricklaying robot; and a centering module installed on the working platform, said centering module comprising;

a device for the sequential transfer of the bricks connecting, at the level of the working platform, the supply module to a take-up zone located at the periphery of the working platform close to the sector in which the robot is working;

at least one centering position which is defined in this take-up zone and in which the bricklaying robot comes to collect the bricks; and at least one centering device arranged with respect to at least one of the centering positions in such a way as to be able to center the bricks at the selected centering position.

2. The device of claim 1 wherein said transfer device of the centering module comprises at least one transfer pusher which can be moved in translation on the working platform between the supply module and said take-up zone.

3. The device of claim 2 wherein said at least one centering device of the centering module comprises, for each centering position;

at least one first stop in the direction of translation of the at least one transfer pusher;

at least one second stop aligned parallel to the direction of translation of the at least one transfer pusher; and at least one movable centering pusher for pushing the bricks to be centered against the second stop.

4. The device of claim 1 wherein said at least one centering device of the centering module is installed on a retractable plate of the working platform, which can be moved in such a way as to bring said centering positions closer to the working position of the brick-laying robot.

5. The device of claim 1 wherein:

said supply module comprises at least two fork lifters located below the working platform along two opposite sides of a supply channel for the stacks of bricks; and wherein each fork lifter comprises forks which can be turned down from a horizontal position, in which they can support a stack of bricks, into a vertical position, defined in such a way as to leave said supply channel completely clear for the passage of stacks of bricks loaded on the lifting module.

6. The device of claim 5 wherein the at least two fork lifters are driven by at least one step motor via a screw-nut system.

7. The device of claim 1 wherein the lifting module comprises a lifting plate driven via cables by winches installed on the working platform, said lifting plate defining a loading surface for at least one stack of bricks.

8. The device of claim 7 wherein at least two stabilizing cables for said plate are tensioned between the working platform and the loading platform.

9. The device of claim 8 wherein at least one motorized drum for the stabilizing cables is installed at the level of the loading platform.

10. The device of claim 8 wherein the lifting plate comprises, for each stabilizing cable, a pair of guiding pulleys.

11. The device of claim 10 including:

a roller conveyor mounted on the loading platform, said roller conveyor extending from the periphery as far as below the lifting module; and wherein said lifting plate comprises notches enabling the rollers of said conveyor to pass at least partially above the loading surface of the lifting plate when the lifting plate is in the loading position.

12. The device of claim 11 wherein said notches in the lifting plate are arranged so as to enable the forks of at least two fork lifters to pass in the horizontal position in order to take up the stacks of bricks from the lifting plate.

13. The device of claim 11 wherein the conveyor for the loading platform has a position for waiting for stacks of bricks opposite the lifting module.

14. The device of claim 1 wherein the loading platform supports a telescopic mast on which the working platform is mounted, and the loading platform can be moved in rotation about a vertical axis.

15. The device of claim 14 comprising:

a depalletizing platform located at the level of said loading platform and including:

a depalletizing robot for forming from pallets with various types of bricks, stacks of bricks according to the needs of said bricklaying robot, said depalletizing robot having a working range, and at least one conveyor for said stacks Of bricks, said at least one conveyor terminating with one end within said working range of said depalletizing robot and with the other end at the periphery of said depalletizing platform, opposite said loading platform, at least one conveyor for said stacks of bricks on said rotary loading platform, said at least one conveyor terminating with one .end at the periphery of said loading platform and said lifting module receiving said stacks of bricks from said at least one conveyor on said rotary loading platform; and a transferring plate movable about the periphery of said rotary loading platform for transferring said stacks of bricks between said at least one conveyor of said depalletizing platform and said at least one conveyor of said rotary loading platform.

16. The device of claim 1 wherein the depalletizing module comprises:

a depalletizing platform installed at the level of the loading platform;

a depalletizing robot installed on the depalletizing platform having a working range over the depalletizing platform;

at least one conveyor for pallets of bricks installed on the depalletizing platform and located at least partially within the working range of the depalletizing robot; and at least one conveyor for said stacks of bricks, which is installed on the depalletizing platform and terminates with one end within the working range of the depalletizing robot and with the other end at the periphery of said depalletizing platform, opposite the loading platform.

17. The device of claim 1 wherein the bricklaying robot comprises:

a base slidingly mounted on said working platform;

a first arm attached to said base so as to be pivotable about a first vertical axis of rotation in relation to said working platform;

a second arm attached to said first arm so as to be pivotable about a second vertical axis of rotation and a horizontal axis of rotation in relation to said first arm;

a grasping device for the bricks supported by said second arm.

18. The device of claim 17 wherein said second arm is formed by two parallel and superimposed bars which are articulated, at one end, to a component attached to the first arm so as to form a second vertical axis and, at the other end, to the grasping device forming a parallelogram which can be deformed in a vertical plane.

19. The device of claim 17 wherein the grasping device has four degrees of freedom in order to provide for the adjustment of the bricks.

20. The device of claim 1 wherein:

the depalletizing module has two independent conveyors extending from the depalletizing module in the direction of the loading platform;

the lifting module has a loading surface designed for two stacks of bricks;

the supply module has a first and a second lifter which are independent with respect to each other and arranged in such a way that they are each able to take up one of the two stacks from said loading surface of the lifting module;

the centering module comprises a centering device which can be moved on the working platform between the supply module and the take-up zone, said centering device being adapted to take up either a brick from the first lifter or a brick from the second lifter or a pair of bricks, and to transfer each brick to the periphery of the working platform; and the centering module further comprises a first centering position for the bricks coming from the first lifter and a second centering position for the bricks coming from the second lifter.

21. Automated installation for lining the wall of an enclosure with brickwork comprising:

a bricklaying robot mounted on a working platform which can be moved vertically and horizontally to enable the bricklaying robot to work in various sectors of said enclosure;

a depalletizing module for forming from pallets with various types of bricks, stacks of bricks according to the needs of the bricklaying robot;

a lifting module, for receiving said stacks of bricks formed by the depalletizing module on a loading platform, said lifting module being capable of transferring the stacks of bricks vertically to the working platform;

a supply module for supplying the working platform, and for taking up said stack of bricks from the lifting module and transferring the bricks sequentially to the level of the working platform, according to the needs of said bricklaying robot;

said supply module comprising at least two fork lifters located below the working platform along two opposite sides of a supply channel for the stacks of bricks; and wherein each fork lifter comprises forks which can be turned down from a horizontal position, in which they can support a stack of bricks, into a vertical position, defined in such a way as to leave said supply channel completely clear for the passage of stacks of bricks loaded on the lifting module.

22. Automated installation for lining the wall of an enclosure with brickwork comprising:

a bricklaying robot mounted on a working platform which can be moved vertically and horizontally to enable the bricklaying robot to work in various sectors of said enclosure;

a depalletizing module for forming from pallets with various types of bricks, stacks of bricks according to the needs of the bricklaying robot;

a lifting module for receiving said stacks of bricks formed by the depalletizing module on a loading platform and for transferring said stacks of bricks vertically from said loading platform to said working platform, said lifting module including:

a loading plate defining a loading surface for at least one stack of bricks;

driving cables and winches for lifting said plate;

at least two stabilizing cables for guiding and stabilizing said loading plate; and at least one motorized drum for tensioning said at least two stabilizing cables between said working platform and said loading platform; and a supply module for supplying the working platform, and for taking up said stack of bricks from the lifting module and transferring the bricks sequentially to the level of the working platform, according to the needs of said bricklaying robot.

23. Automated installation for lining the wall of an enclosure with brickwork comprising:

a working platform;

a bricklaying robot mounted on said working platform;

a rotary loading platform;

a vertical telescopic mast supporting said working platform on said rotary loading platform;

a depalletizing platform located at the level of said loading platform including:

a depalletizing robot for forming from pallets with various types of bricks, stacks of bricks according to the needs of said bricklaying robot, said depalletizing robot having a working range, and at least one conveyor for said stacks of bricks, said at least one conveyor terminating with one end within said working range of said depalletizing robot and with the other end at the periphery of said depalletizing platform, opposite said loading platform;

at least one conveyor for said stacks of bricks on said rotary loading platform, said at least one conveyor terminating with one end at the periphery of said loading platform;

a transferring plate movable about the periphery of said rotary loading platform for transferring said stacks of bricks between said at least one conveyor of said depalletizing platform and said at least one conveyor of said rotary loading platform;

a lifting module for receiving said stacks of bricks from said at least one conveyor of said rotary loading platform and for transferring them vertically to said working platform; and a supply module for taking up said stacks of bricks from said lifting module and transferring the bricks sequentially to the level of said working platform, according to the needs of said bricklaying robot.

24. Automated installation for lining the wall of an enclosure with brickwork comprising:

a bricklaying robot mounted on a working platform which can be moved vertically and horizontally to enable said bricklaying robot to work in various sectors of said enclosure, said bricklaying robot including:

a grasping device for the bricks, a base slidingly mounted on said working platform, a first arm attached to said base so as to be pivotable about a first vertical axis of rotation in relation to said working platform, a component attached to said first arm so as to be pivotable about a second vertical axis of rotation in relation to said first arm, and a second arm attached to said component so as to be pivotable about a horizontal axis of rotation in relation to said component, said second arm including two parallel superimposed bars articulated, at one end, to said component and, at the other end, to said grasping device so as to form a parallelogram which can be deformed in a vertical plane;

a depalletizing module for forming from pallets with various types of bricks, stacks of bricks according to the needs of the bricklaying robot;

a lifting module, for receiving said stacks of bricks formed by the depalletizing module on a loading platform, said lifting module being capable of transferring the stacks of bricks vertically to the working platform;

a supply module for supplying the working platform, and for taking up said stack of bricks from the lifting module and transferring the bricks sequentially to the level of the working platform, according to the needs of said bricklaying robot.

* * * * *